US005788610A

United States Patent [19]

Eschenbach

[11] Patent Number: 5,788,610

[45] Date of Patent: Aug. 4, 1998

[54] ELLIPTICAL EXERCISE MACHINE WITH ARM EXERCISE

[76] Inventor: Paul William Eschenbach, 143 Lakeland Ave., Moore, S.C. 29369

[21] Appl. No.: 711,087

[22] Filed: Sep. 9, 1996

[51] Int. Cl.[6] ..... A63B 69/16; A63B 22/04

[52] U.S. Cl. ..... 482/52; 482/70; 482/51

[58] Field of Search ..... 482/51, 52, 53, 482/57, 70, 71, 74, 79, 80, 62

[56] References Cited

U.S. PATENT DOCUMENTS

| | | | |
|---|---|---|---|
| 5,290,211 | 3/1994 | Stearns | 482/52 |
| 5,433,680 | 7/1995 | Knudsen | 482/57 |
| 5,518,473 | 5/1996 | Miller | 482/51 |
| 5,529,555 | 6/1996 | Rodgers | 482/57 |
| 5,562,574 | 10/1996 | Miller | 482/51 |
| 5,573,480 | 11/1996 | Rodgers | 482/57 |
| 5,577,985 | 11/1996 | Miller | 482/52 |

*Primary Examiner*—Stephen R. Crow

[57] ABSTRACT

An exercise apparatus is provided that simulates jogging, running and climbing with elliptical pedal motion and arm exercise. The pedals are guided by extended foot supports that have one pedal pivot following an elongate curve path while the other pedal pivot follows a different curve path. In the preferred embodiment, the elongate curve path is provided by a four-bar linkage coupler point while a rocker link extension provides arm lever exercise. Pedal motion and arm exercise can be adjusted during operation of the exercise apparatus.

34 Claims, 8 Drawing Sheets

ELLIPTICAL EXERCISE MACHINE WITH ARM EXERCISE

BACKGROUND OF THE INVENTION

1. Field

The present invention relates to a standup exercise apparatus that simulates jogging, running and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance change over many minutes of cycling and a clever display to capture the attention of the user. More recently, computers interface with the user to vary the exercise routine. However, the issue of extensive time, limited muscle usage and arm exercise are not addressed.

Hand cranks and swing arms have long been applied to arm exercise. More recently swing arms have been more popular in commercial and home exercise equipment.

Swing arms for arm exercise are used by Carlson et al. in U.S. Pat. No. 4,772,015 to arm wrestle while Carlson in U.S. Pat. No. 4,720,099 adapts swing arms for a variety of arm and leg motions in one machine. Iams et al. in U.S. Pat. No. 4,674,740 applies spring loaded handles in a prone platform supporting position to simulate the arm motion of swimming. Berne in U.S. Pat. No. 2,921,791 and McGillis et al. in U.S. Pat. No. 4,872,668 use articulated arms for various arm exercise.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Arm levers combined with a foot crank for sit down exercise has grown popular in the last 20 years of fitness. Glaser in U.S. Pat. No. 3,727,913 shows reciprocating handle and seat coupled to a foot crank. Yount et al. in U.S. Pat. No. 3,759,512 shows spring loaded arm levers and foot crank. Mester in U.S. Pat. No. 3,966,201 provides independent levers with a foot crank for various sit down exercise. Hooper in U.S. Pat. No. 4,188,030 couples a pair of swing arms to a foot crank with a crank eccentric for sit down exercise having air resistance.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

In recent years, stair climbers have become very popular due to the higher loading possible with standup exercise as well as different muscles used compared to sit down exercise. The Stairmaster U.S. Pat. No. 4,708,338 is one of the most popular stair climbers allowing up and down independent parallel foot pedal movement with programmed load variation over multiple cycles as well as a clever display to hold the attention of the user. Young et al. in U.S. Pat. No. 4,989,858 adds arm levers to the stair climber concept for arm exercise.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical linkage and horizontal linkage to guide the foot pedals. The pedal pivots move through similar undefined guide paths.

Standup pedaling approaches the benefits of running to the cardiovascular system because a higher load resistance is possible over sit down cycling. Dr. Cooper in his book entitled THE AEROBICS PROGRAM FOR TOTAL WELL-BEING by Dr. Kenneth Cooper, Bantam Books, New York, 1982 awards only half the benefit points to sit down stationary cycling (page 260) over regular cycling which includes an equal amount of uphill and down hill course (page 255). Dr. Cooper grades running better than regular cycling, but without the downhill rest inherent in regular cycling, it is certain that standup cycling with vigorous arm exercise would exceed running for cardiovascular benefits in less time.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an ellipitical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track. None of these pedal operated exercise machines anticipate pedal motion whereby one pedal pivot is guided by an oblong guide path curve while the other pedal pivot is guided by a different guide path curve.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle. It is an object of this invention to guide the pedal pivots with two different guide path curves having a reversable pedal cycle.

Recently, two new elliptical exercise machines have been introduced to the Club Industry. The Body Trek by Cross Conditioning Systems of Boulder, Colo. offers elliptical pedal motion whereby a slider-crank mechanism is used to generate an elliptical pivot path by using a pedal pivot located generally on the centerline of the coupling link between the crank pivot and the slider pivot. An extended pedal support member is guided by a rocker link pivotally attached to the framework. The Elliptical Cross Trainer by Life Fitness of Franklin Park, Ill. also generates an elliptical pedal path with a pedal pivot located generally on the centerline of a coupling link between the crank pivot and the slider pivot. The other pedal pivot is attached to the slider by a connecting link. Both elliptical exercise machines use rollers in a linear track as the slider causing noise and service problems. It is one objective of this invention to eliminate the crank-slider track in the preferred embodiment. Another object of this invention is to replace a generally symmetrical elliptical pivot path guide curve with a bent oblong pivot path guide curve wherein the flater parts of the oblong curve are generally curved or bent in the same direction. Yet another object of this invention is to demonstrate mechanism that will change the pedal motion during operation of the exercise machine.

There is a need for a pedal operated quiet exercise machine that can be safely operated in the standup position whereby the arms and legs can be exercised with the feet moving through a generally elliptical path while the pedals remain relatively horizontal during a part of the pedal cycle. There is a further Need for an exercise machine that has adjustable pedal and arm motion during operation to exercise different muscles.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to be generally horizontal during the pedal cycle where the leg is generally extended. As the foot is raised, the heel of the foot remains generally in contact with the inclining pedal for safer operation. Arm exercise is by arm levers coordinated with the mechanism guiding the foot pedals. An adjustment mechanism is provided to move one of the pivots of the path generating mechanism during operation to change the pedal motion and the arm exercise motion.

In the preferred embodiment, the apparatus includes a separate pedal for each foot, each pedal being extended by a foot support member and partially supported by an oblong guide path curve at the first foot support pivot wherein the path generating mechanism has a rotary crank which completes one full revolution during a pedal cycle and is phased generally opposite the crank for the other pedal through a bearing journal attached to the framework. The bearing journal is supported by a crankshaft bearing housing which is located at a predetermined distance relative to the movable upright support. Connected to the crank is a coupling link which is also connected to a rocker link which is pivotally attached to a movable upright support. The coupling link is extended to a coupler point pivot, forming a triangular pivot pattern with the other two pivots, which will generate the desired oblong or elongate guide path curve as a coupler curve of a four-bar linkage referred to in the literature as a crank-rocker mechanism. A change in the proportions of a crank-rocker mechanism will change the motions of the links. The predetermined distance between the crankshaft bearing housing and the rocker link pivot is changed by moving the upright support member during operation. The first foot support pivot is attached to the coupler link at the coupler point pivot.

The foot supports are also pivotally supported on the foot support member at a second pedal pivot by foot support guides or rocker arms which are rotatably connected to an upright support member of the framework. An actuator is pivotally attached to the movable upright support and the other upright support member to adjust the predetermined distance between the crankshaft bearing housing and the movable upright support. Extension or retraction of the actuator causes the movable upright support to pivot at the base and relocates the rocker arm pivot of the path generating mechanism whereby the oblong guide path curve is changed in shape and in orientation. The changed oblong guide path curve gives different motion to the pedals and arm levers to exercise different muscles.

In another embodiment, a roller is pivotally connected to a second foot support pivot such that a track attached to the framework having an elongate shape similar to a banana as the guide path curve for a second foot support pivot on the foot support member. A first foot support pivot on the foot support member is guided by an arc path provided by a rocker link pivotally attached to the first foot support pivot and the movable upright support member. A coupling link is pivotally attached to the rocker link and pivotally attached to a rotary crank which completes one full revolution during a pedal cycle and is phased generally opposite the crank for the other pedal through a bearing journal attached to the framework. The arm levers are attached to the coupling link to provide the user with elliptical arm exercise which can be changed during operation by changing the location of the rocker link pivot relative to the crankshaft bearing housing.

The movable upright support is pivoted at the base and can swing front to back according to the position of the actuator pivotally attached to the movable upright support and a frame member. When the actuator is extended or retracted, the rocker pivot moves to relocate the arc guide path curve. Alternately, the arc guide path curve can be a track attached to the movable upright support which guides a roller attached to the first foot support pivot. Both the pedal motion and the elliptical hand path can be changed by the actuator during operation to exercise different muscles.

Load resistance is applied to the crank in both embodiments by a sprocket which drives a chain to a smaller sprocket attached to a rotating flywheel supported by the framework. In both embodiments, the flywheel must overcome the frictional force provided by disc brake pads on either side of the flywheel. Adjustment of the pad force upon the flywheel provides variable intensity exercise for the operator.

In summary, this invention provides the operator with stable foot pedal support having motions that simulate running, climbing and cycling with very low joint impact while offering different pedal motion and upper body exercise.

DETAILED DESCRIPTION OF THE EMBODIMENTS

Figure 1:
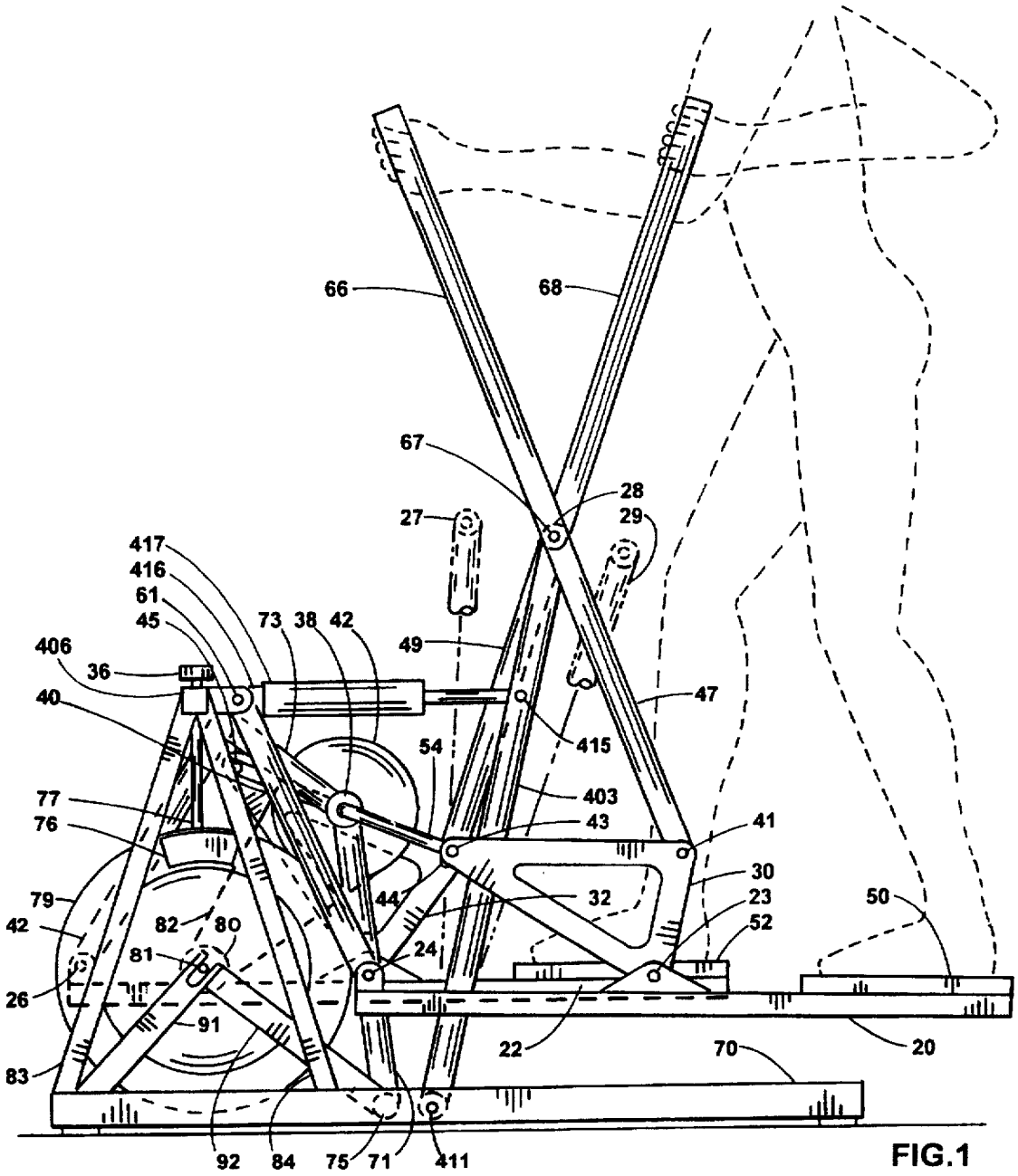
FIG. 1 is a right side elevation view of the preferred embodiment of an exercise machine constructed in accordance with the present invention.
Figure 2:
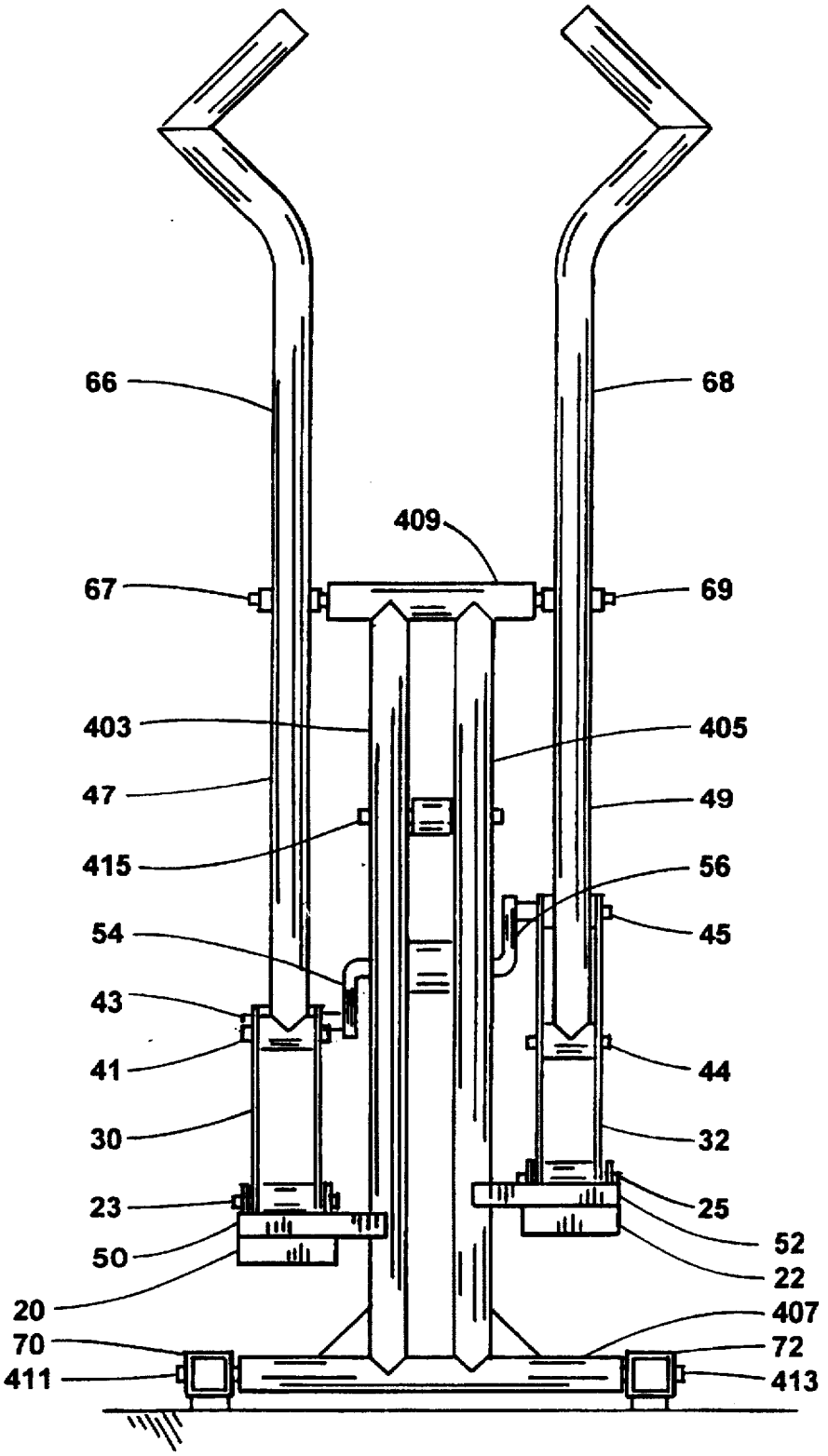
FIG. 2 is the front view of the preferred embodiment shown in FIG. 1.
Figure 3:
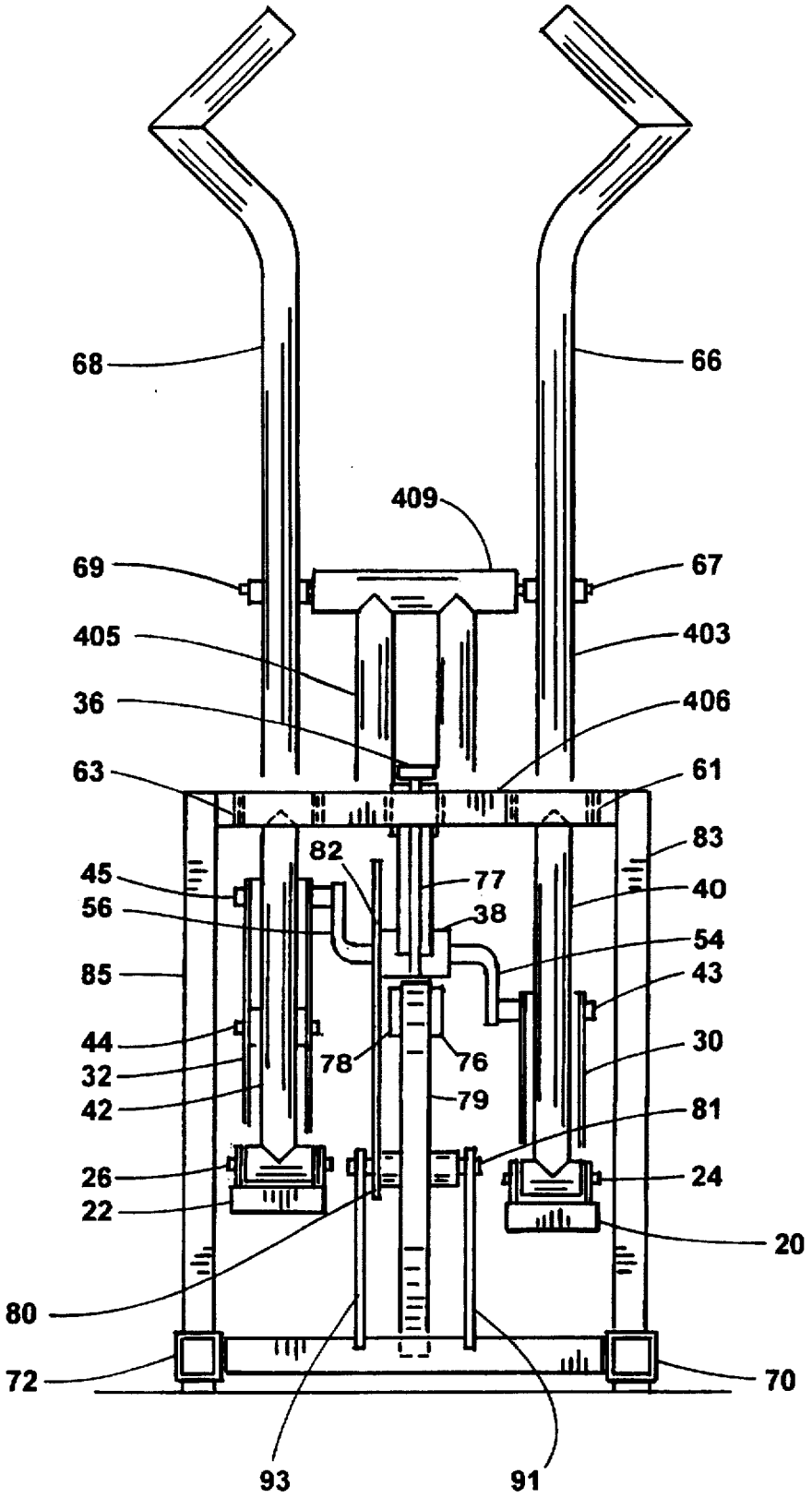
FIG. 3 is the rear view of the preferred embodiment shown in FIG. 1.
Figure 4:
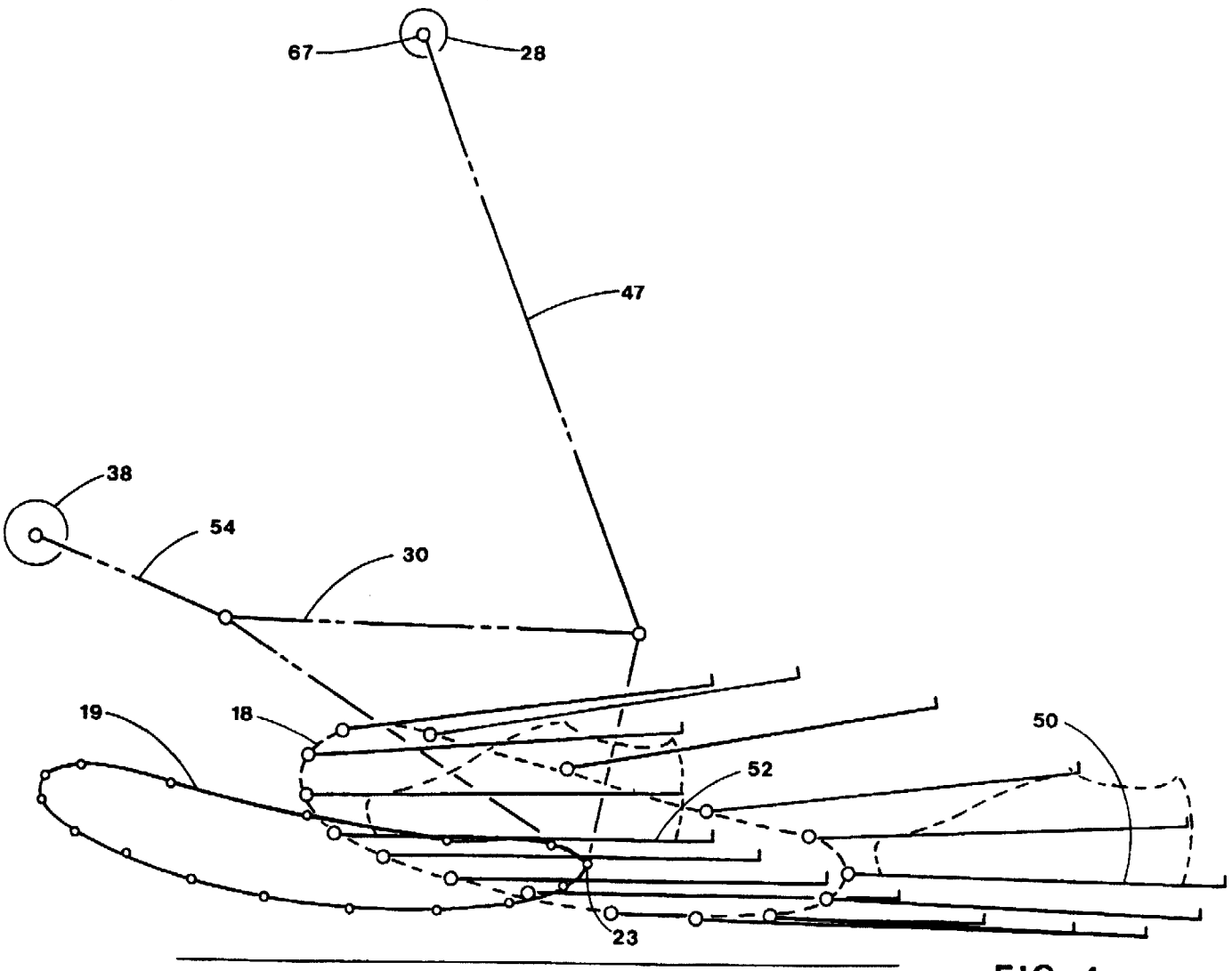
FIG. 4 is the motion of the pedals for the configuration of FIG. 1.

Referring to the drawings in detail, pedals 50 and 52 are shown in FIGS. 1, 2 and 3 in the most forward and rearward positions of the first embodiment. Pedals 50 and 52 are supported by foot support members 20 and 22 which have first foot support pivots 23,24 and second foot support pivots 25,26, respectively. Foot support pivots 23 and 25 are pivotally attached to coupler links 30 and 32 which guide foot support pivots 23 and 25 along an oblong guide path curve 19 as shown in FIG. 4. Coupler link 30 is pivotally attached to rocker arm 47 at pivot 41 and to crank 54 at pivot 43 while coupler link 32 is pivotally attached to rocker link 49 at pivot 44 and to crank 56 at pivot 45. Cranks 54 and 56 are connected in opposing directions by crankshaft journal 55 (not shown) which is rotatably secured to the framework by bearing housing 38. Rocker arms 47 and 49 are pivotally attached to upright support cross member 409 at pivots 67 and 69, respectively. Rocker arms 47 and 49 extend upward to become arm levers 66 and 68 for arm exercise.

Foot support pivots 24 and 26 are pivotally connected to rocker links 40 and 42 which are pivotally attached to frame crossover member 406 at pivots 61 and 63.

Frame members 70 and 72 are configured to be supported by the floor and are connected by crossover members 75 and 87. The upright support members 403 and 405 are connected to crossover members 407 which is pivotally attached to frame members 70 at pivot 411 and to frame member 72 at pivot 413 on one end and attached to crossover member 409 on the other.

Figure 5:
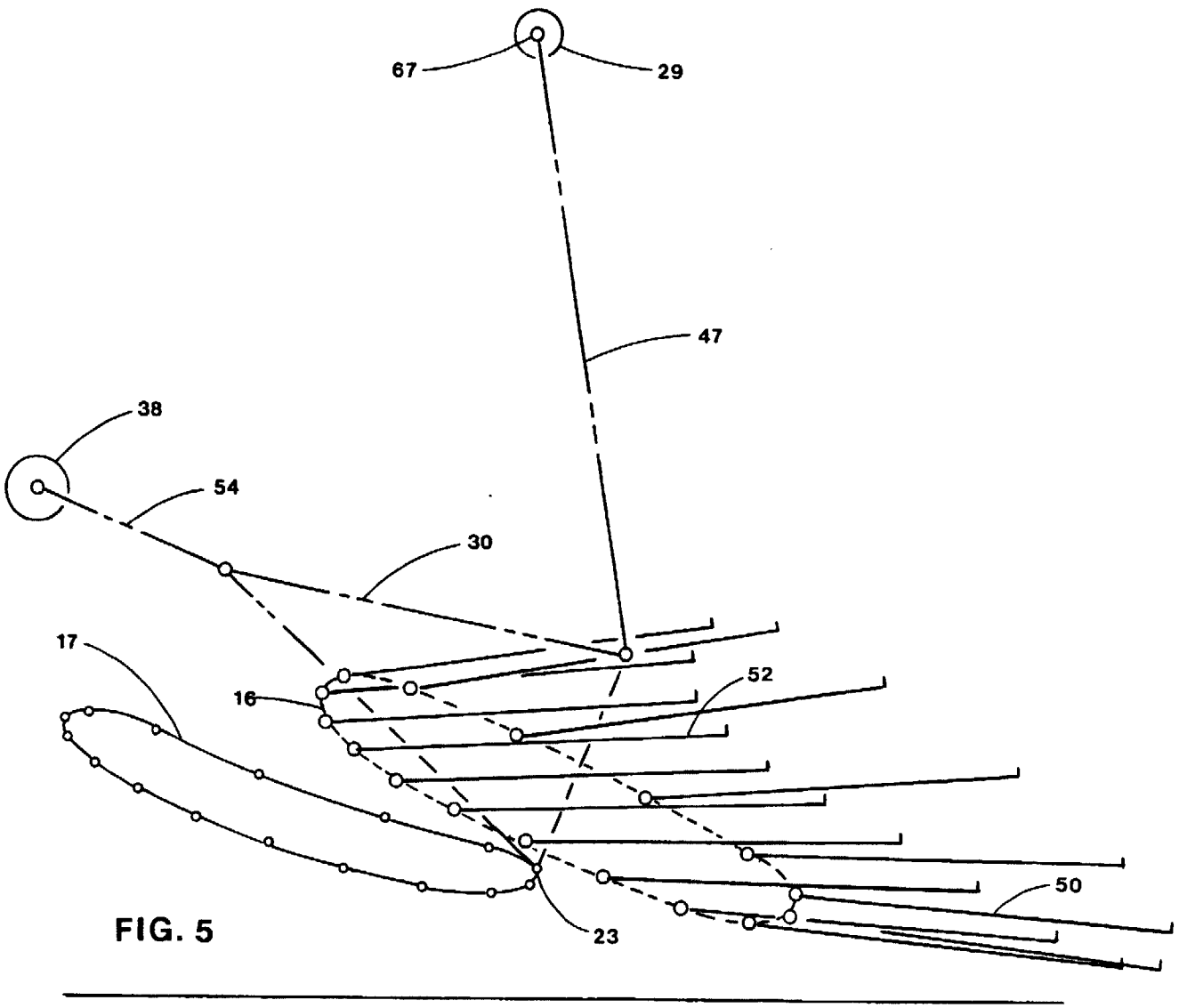
FIG. 5 is the motion of the pedals with the actuator extended.
Figure 6:
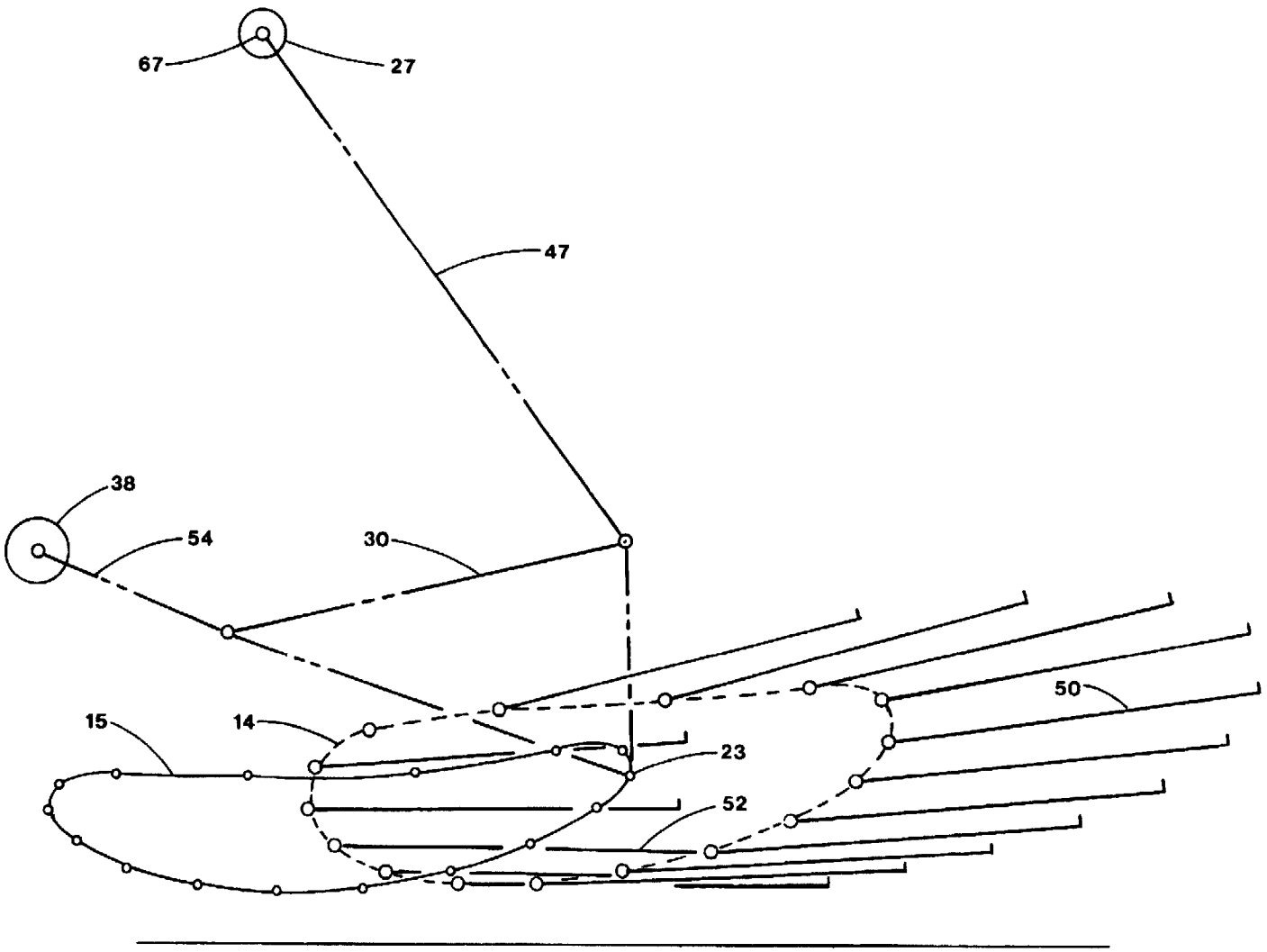
FIG. 6 is the motion of the pedals with the actuator retracted.

Actuator 417 is pivotally connected to upright support members 403 and 405 at pivot 415 on one end and to frame crossover member 406 at pivot 416. The foot pedal path is changed during operation by adjustment of actuator 417, as it receives an electrical signal, to change the distance between crankshaft bearing housing 38 and crossarm member 409. Moving rocker link pivot 67 moves the arcuate path of rocker link pivot 41 to change the proportions of the crank-rocker mechanism which changes the path of coupler point pivot 23. Since the foot support pivot 23 curve changes, the toe path 18 of pedal 50 will also change. The middle position of the actuator 417 is shown in FIG. 1 as position 28 of the crossover member 409 with corresponding foot pedal 50,52 motion shown in FIG. 4 with first foot support pivot bent oblong guide path curve 19, toe path 18 and links 54, 30 and 47. The extended position of actuator 417 is shown by position 29 of the crossover member 409 with corresponding foot pedal 50,52 motion shown in FIG. 5 with first foot support pivot guide bent oblong path curve 17, toe path curve 16 and links 54, 30 and 47. The retracted position of the actuator 417 is shown by position 27 of crossover member 409 with foot pedal 50,52 motion shown in FIG. 6 with first foot support pivot bent oblong guide path curve 15, toe path curve 14 and links 54, 30 and 47. The arm levers 66 and 68 move forward and rearward with the different positions of the crossover member 409 to vary the arm exercise working different muscles.

Frame crossover member 406 is attached to frame member 70 by inclined support members 83 and 84 and connected to frame member 72 by inclined support members 85 and 86. Crank bearing housing 38 is connected to inclined support member 71 which is attached to crossover member 75 and attached to inclined support member 73 which is attached to crossover member 406.

Flywheel 79 is rotatably supported at pivot 81 which is journaled to flywheel support members 91,92 which are connected to horizontal frame member 70, and flywheel support members 93,44 which are connected to horizontal frame member 72. Load resistance is imposed upon crank 54 by sprocket 42 which is connected to a smaller sprocket 80 by chain 82 to drive the flywheel 79. Brake pads 76 and 78 apply frictional resistance to flywheel 79 rotation by mechanism 77 attached to crossover support 406. Load resistance is varied by turning knob 36.

Application of body weight on the pedals 50,52 and force applied at the arm levers 66,68 cause the four-bar linkage to rotate the flywheel 79 for a gain in momentum. This flywheel 79 momentum will carry the linkage system through any dead center positions of the crank 54,56. The pedals 50,52 and arm levers 66,68 can be operated to drive the flywheel 79 in either direction of rotation.

Figure 7:
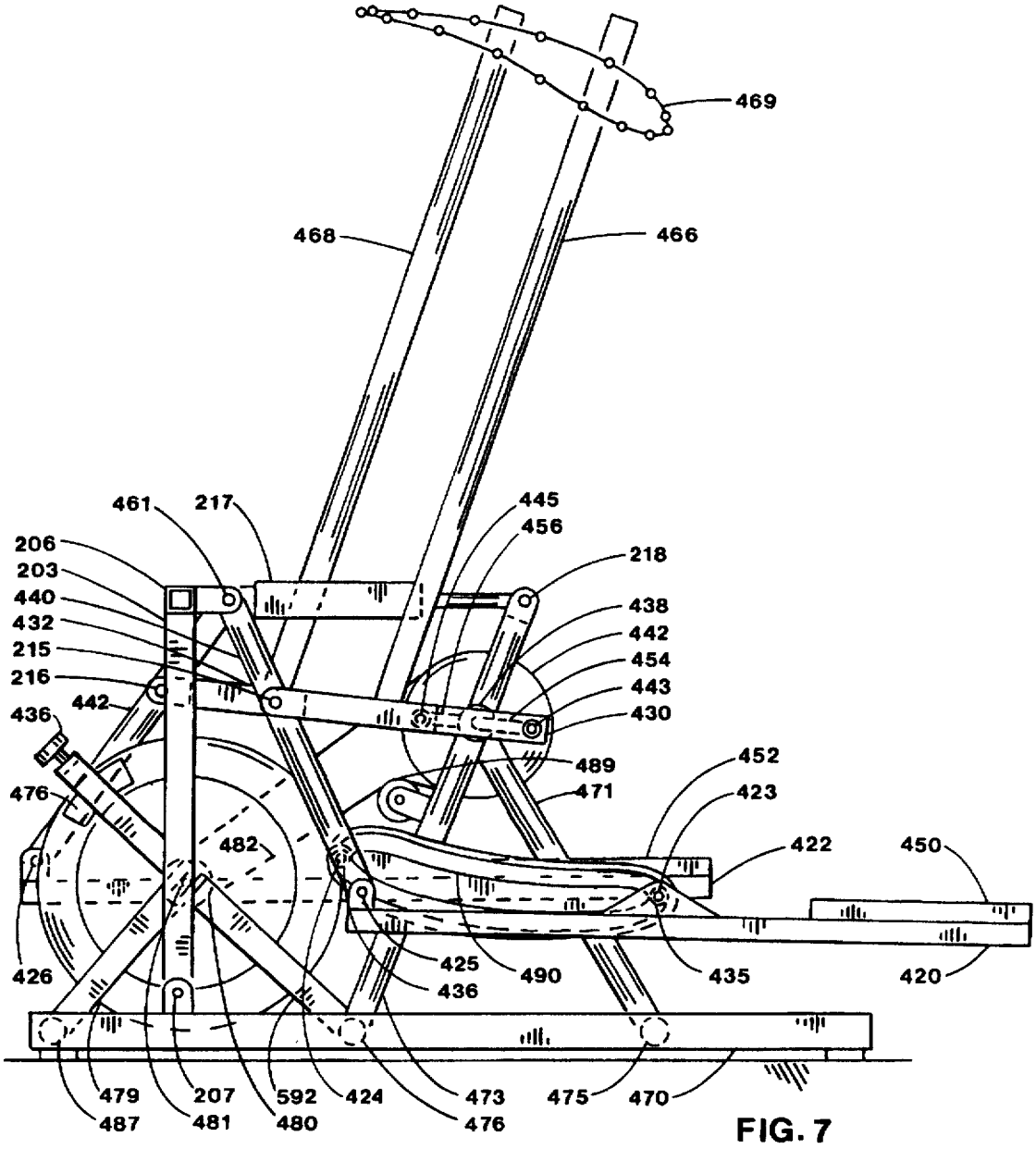
FIG. 7 is a right side elevation view of the alternate embodiment of the present invention.
Figure 8:
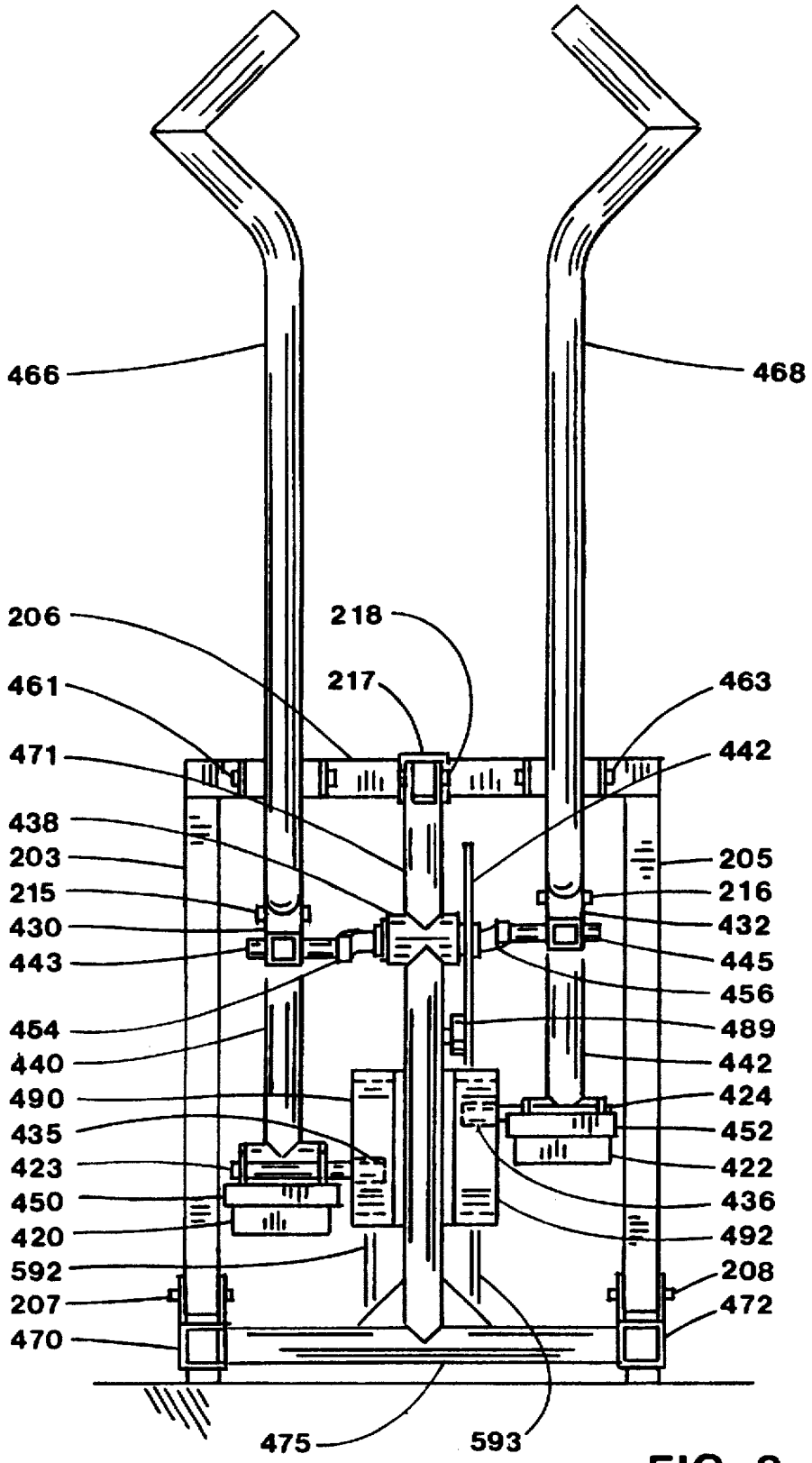
FIG. 8 is a front view of the alternate embodiment shown in FIG. 7.

Another embodiment of the present invention is shown in FIGS. 7 and 8 where pedals 450 and 452 are shown in their most forward and rearward positions. Pedals 450 and 452 are supported by foot support members 420 and 422 which have second foot support pivots 423,424 and first foot support pivots 425,426, respectively. Foot support pivots 423 and 424 are pivotally attached to rollers 435 and 436 which guide foot support pivots 423 and 424 along an elongate guide path curve provided by tracks 490 and 492 each having a banana shape. Tracks 490 and 492 are attached to inclined support members 471 and 473.

Foot support pivots 425 and 426 are pivotally connected to rocker arms 440 and 442 which are pivotally attached to frame crossover member 206 at pivots 461 and 463. Crossover member 206 is connected to upright supports 203 and 205 on one end and pivotally attached to frame member 470 at pivot 207 and to frame member 472 at pivot 207. Actuator 217 is pivotally attached to crossover support 206 on one end and pivotally attached to support member 473 at pivot 218. Actuator 217 controls the predetermined distance between crankshaft bearing housing 438 and the movable upright support 206. Adjustment of this distance during operation changes the proportions of the crank-rocker mechanism. When the location of the acruate path made by foot support pivot 425 is changed, the pedal 450 follows a different path similar to the toe path 14,16,18 shown in FIGS. 4,5, and 6.

Coupler link 430 is pivotally attached to rocker arm 440 at pivot 215 and to crank 454 at pivot 443 while coupler link 432 is pivotally attached to rocker link 216 at pivot 426 and to crank 456 at pivot 445. Cranks 454 and 456 are connected in generally opposing directions by crankshaft journal 455 (not shown) which is rotatably secured to support member 473 by bearing housing 438. Arm lever 466 is attached to coupler link 430 and while arm lever 468 is attached to coupler link 432 to provide generally elongate hand paths 469 for arm exercise. Alternately the rocker arms 440 and 442 could be coupled to arm levers 466 and 468 to provide swing arm exercise. When the actuator 217 is adjusted during operation, the coupler link 430 moves with a different motion and changes the hand path 469 motion.

Frame members 470 and 472 are configured to be supported by the floor and are connected by crossover members 476 and 487. Crank bearing housing 438 is connected to inclined support member 473 which is attached to crossover member 476 which is attached to frame members 470 and 472. Support member 471 is connected to crank bearing housing 438 on one end and connected to crossover support 475 on the other end.

Flywheel 479 is rotatably supported at pivot 481 which is journaled to support members 592 and 593. Load resistance is imposed upon crank 454 by sprocket 442 which is connected to a smaller sprocket 480 by chain 482 to drive the flywheel 479. Brake pads 476 and 478 apply frictional resistance to flywheel 479 rotation by mechanism 477 attached to inclined support 592. Load resistance is varied by turning knob 436.

Application of body weight on the pedals 450,452 and force applied at the arm levers 466,468 cause the four-bar linkage to rotate the flywheel 479 for a gain in momentum. This flywheel 479 momentum will carry the linkage system through any dead center positions of the crank 454,456. The pedals 450,452 and arm levers 466,468 can be operated to drive the flywheel 479 in either direction of rotation. Body weight on the pedals and proper phasing of the opposed cranks 454,456 assure the rollers 435,436 maintain the correct direction in the tracks 490 and 492.

The advantages of the first embodiment include a plurality of links supporting a pedal using only simple pivots and a single crank. Since most of the users body weight is supported by the rocker pivots, the crank is lightly loaded allowing a simple one piece bicycle crank to be used. The pedal curve for the foot can be a smooth ellipse while neither of the foot support pivot guidance curves are ellipses.

The second embodiment advantages include a low profile track that allows a low profile housing to cover the moving parts. The arm exercise curve is a closed oblong curve allowing additional muscles to be exercised over simple swing arms.

Both embodiments have the advantage of adjustable pedal and arm motion during operation. This allows a computer to control the actuator to provide uphill, downhill and walking pedal curves without stopping the exercise.

What is claimed is:

1. An exercise machine comprising:

a framework means, said framework means having an upright support means connected to said framework means;

a pair of foot support means, each having a first and a second foot support pivot and a foot engaging pedal means;

a crankshaft bearing housing means connected to said framework means at a predetermined distance relative to said upright support means and having a crank means projecting outwardly therefrom on both sides thereof;

a linkage means, said linkage means including said crank means, a rocker link means operably associated with said upright support means and, a coupler link means interposed between each said crank means and said rocker link means, said linkage means forming a crank-rocker mechanism to guide said first foot support pivot with a pivot means;

a foot support guide means, said foot support guide means being operably associated with said linkage means and operably associated with said framework means;

said first foot support pivot connected pivotally to said linkage means at said pivot means, said second foot support pivot connected pivotally to said foot support guide means to allow said foot support means to move relative to said upright support means when the foot of the user is rotating said crank means whereby said foot engaging pedal means follows an oblong curve path.

2. The exercise machine according to claim 1 wherein said oblong curve path is generally elliptical in shape.

3. The exercise machine according to claim 1 further comprising an adjustment means for changing the predetermined distance between the crank bearing housing means and the upright support means whereby said upright support means is movable relative to said framework means by said adjustment means such that the angle of said foot engaging pedal means can be changed by said adjustment means during operation of said exercise machine.

4. The exercise machine according to claim 1 further comprising an adjustment means for changing the predetermined distance between the crank bearing housing means and the upright support means whereby said upright support means is movable relative to said framework means by said adjustment means such that the orientation of said oblong curve path can be changed by said adjustment means during operation of said exercise machine.

5. The exercise machine according to claim 1 whereby said rocker link means is pivotally attached to said upright support means to guide one of said coupler link pivots along an arcuate path.

6. The exercise machine according to claim 1 further comprising an arm exercise means operably associated with said upright support means.

7. The exercise machine according to claim 4 further comprising an arm exercise means operably associated with said upright support means wherein said arm exercise means is adjustable during operation of said exercise machine.

8. The exercise machine according to claim 1 further comprising a flywheel means operably associated with said crank means.

9. The exercise machine according to claim 1 further comprising a load resistance means operably associated with said crank means.

10. The exercise machine according to claim 1 wherein said foot support guide means is a lever pivotally connected to said second foot support pivot on one end and pivotally connected to said framework means on the other end.

11. The exercise machine according to claim 1 wherein said foot support means is an elongated lever having said foot engaging pedal means on one end of said elongated lever with said first and said second foot support pivot on the other end of said elongated lever.

12. The exercise machine according to claim 1 wherein said pivot means is part of a triangular pivot pattern attached to said coupler link means and connected to said first foot support pivot.

13. The exercise machine according to claim 1 wherein said foot engaging pedal means follows a generally elliptical curve while said first foot support pivot follows a bent oblong guide path curve and said second foot support pivot follows an arcuate guide path curve.

14. The exercise machine according to claim 1 wherein said foot support guide is a roller means pivotally attached to said second foot support pivot and a track means attached to said framework means whereby said track means guides said roller means during a pedal cycle.

15. The exercise machine according to claim 1 wherein said pivot means is attached to said rocker link means and pivotally connected to said first foot support pivot.

16. An exercise machine comprising:

a framework means, said framework means having an upright support means connected to said framework means;

a pair of foot support means, each having a first and a second foot support pivot and a foot engaging pedal means;

a crankshaft bearing housing means connected to said framework means at a predetermined distance relative to said upright support means and having a crank means projecting outwardly therefrom on both sides thereof;

a rocker link means, said rocker link means operably associated with said upright support means;

a triangular shaped coupler link means, said coupler link means having a predetermined pivot pattern including a coupler point pivot, said coupler link means pivotally interposed between each said crank means and said rocker link means, collectively forming a crank-rocker mechanism;

a foot support guide means, said foot support guide means operably associated with said framework means;

said first foot support pivot pivotally connected to said coupler point pivot and said second foot support pivot pivotally connected to said foot support guide means to allow said foot support means to move relative to said upright support means when the foot of the user is rotating said crank means whereby said foot engaging pedal means follows an oblong curve path.

17. The exercise machine according to claim 16 wherein said coupler point pivot provides a guidance curve for said first support pivot that is a bent oblong curve path whereby said foot engaging pedal means follows an elliptical path.

18. The exercise machine according to claim 16 further comprising an adjustment means for changing the predetermined distance between the crank bearing housing means and the upright support means whereby said upright support means is movable relative to said framework means by said adjustment means such that the angle of said foot engaging pedal means can be changed by said adjustment means during operation of said exercise machine.

19. The exercise machine according to claim 16 whereby said rocker link means is pivotally attached to said upright support means to guide one of said coupler link pivots along an arcuate path.

20. The exercise machine according to claim 16 further comprising an arm exercise means operably associated with said upright support means.

21. The exercise machine according to claim 18 further comprising an arm exercise means operably associated with said upright support means wherein said arm exercise means is adjustable during operation of said exercise machine.

22. The exercise machine according to claim 16 further comprising a load resistance means operably associated with said crank means.

23. The exercise machine according to claim 16 wherein said foot support guide means is a lever pivotally connected to said second foot support pivot on one end and pivotally connected to said framework means on the other end.

24. The exercise machine according to claim 16 wherein said foot support means is an elongated lever having said first foot support pivot interposed said foot engaging pedal means on one end of said elongated lever and said second foot support pivot on the other end of said elongated lever.

25. An exercise machine comprising:

a framework means, said framework means having an upright support means connected to said framework means;

a pair of foot support means, each having a first and a second foot support pivot and a foot engaging pedal means;

a crankshaft bearing housing means connected to said framework means at a predetermined distance relative to said upright support means and having a crank means projecting outwardly therefrom on both sides thereof;

a linkage means operably associated with said upright support means, said linkage means containing a plurality of link members having a single said crank means, being sufficient to guide one of said foot support pivots along a bent oblong guide path curve as said crank means is rotated;

a foot support guide means, said foot support guide means operably associated with said framework means to provide an arcuate guide path curve;

said first foot support pivot means pivotally connected to said pivot means and said second foot support pivot pivotally connected to said foot support guide means to allow said foot support means to move relative to said upright support means when the foot of the user is rotating said crank means whereby said foot engaging pedal means follows a generally elliptical curve path while said first foot support pivot follows the bent oblong guide path curve and said second foot support pivot follows the arcuate guide path curve.

26. The exercise machine according to claim 25 further comprising an adjustment means for changing the predetermined distance between the crank means pivot and the upright support means pivot whereby said upright support means pivot is movable relative to said framework means by said adjustment means such that the angle of said foot engaging pedal means can be changed by said adjustment means during operation of said exercise machine.

27. The exercise machine according to claim 25 further comprising an adjustment means for changing the predetermined distance between the crank means pivot and the upright support means pivot whereby said upright support means pivot is movable relative to said framework means by said adjustment means such that the orientation of said oblong curve path can be changed by said adjustment means during operation of said exercise machine.

28. The exercise machine according to claim 25 further comprising an arm exercise means operably associated with said linkage means.

29. The exercise machine according to claim 26 further comprising an arm exercise means operably associated with said upright support means wherein said arm exercise means is adjustable during operation of said exercise machine.

30. The exercise machine according to claim 25 wherein said linkage link means has at least one link member with three pivots forming a triangular pivot pattern containing said pivot means.

31. The exercise machine according to claim 25 further comprising a load resistance means operably associated with said crank means.

32. An exercise machine comprising:

a framework means, said framework means having an upright support means pivotally connected to said framework means;

a pair of foot support means, each having a first and a second foot support pivot and a foot engaging pedal means;

a crankshaft bearing housing means connected to said framework means at a predetermined distance relative to said upright support means and having a crank means projecting outwardly therefrom on both sides thereof;

a rocker link means, said rocker link means operably associated with said upright support means;

a triangular shaped coupler link means, said coupler link means having a predetermined pivot pattern including a coupler point pivot, said coupler link means pivotally interposed between each said crank means and said rocker link means;

a foot support guide means, said foot support guide means operably associated with said framework means;

said first foot support pivot means pivotally connected to said coupler point pivot and said second foot support pivot pivotally connected to said foot support guide means to allow said foot support means to move relative to said upright support means when the foot of the user is rotating said crank means;

an arm exercise means operably associated with said upright support means;

an adjustment means for changing said predetermined distance between said crank bearing housing means and said upright support means whereby said upright support means is movable relative to said framework means by said adjustment means such that the angle of said foot engaging pedal means and the position of said arm exercise means can be changed by said adjustment means during operation of said exercise machine.

33. The exercise machine according to claim 32 wherein said upright support is pivotally attached to said framework means and pivotally attached to said adjustment means which is an actuator operably activated by electrical current to move said upright support.

34. The exercise machine according to claim 32 wherein said arm exercise means is a pair of levers extending upwards connected to each said rocker link means.

* * * * *